US005706520A

United States Patent [19]

Thornton et al.

[11] Patent Number: 5,706,520

[45] Date of Patent: Jan. 13, 1998

[54] HAND PUNCTURE PROTECTOR

[75] Inventors: Bonnie Crocetti Thornton, Olney; Ann Peterson, Rockville; Mary Allen, Columbia; Barbara Fahey, Gaithersburg; Myra Woolery-Antill, Baltimore, all of Md.; Jerry B. Taylor, Ashburn Farms, Va.; Vera Wheeler, San Diego, Calif.; Peggy Coleman, Vienna, Va.; Shirley M. Kedrowski, Palo Alto, Calif.; Lisa Ann Jeanneret, Herndon, Va.

[73] Assignee: The United States of America as represented by the Department of Health and Human Services, Washington, D.C.

[21] Appl. No.: 515,499

[22] Filed: Aug. 15, 1995

[51] Int. Cl.[6] ..... A41D 13/10

[52] U.S. Cl. ..... 2/21; 2/2.5

[58] Field of Search ..... 2/21, 16, 163, 2/169, 159, 2.5

[56] References Cited

U.S. PATENT DOCUMENTS

| | | | |
|---|---|---|---|
| 1,483,595 | 2/1924 | Read | 2/21 X |
| 1,951,190 | 3/1934 | Gambee | 2/21 |
| 4,413,357 | 11/1983 | Sacks . | |
| 4,573,220 | 3/1986 | Baker . | |
| 4,638,511 | 1/1987 | Haack . | |
| 4,689,828 | 9/1987 | Brewer . | |
| 4,751,747 | 6/1988 | Banks et al. . | |
| 4,825,470 | 5/1989 | Horio . | |
| 4,894,866 | 1/1990 | Walker . | |
| 4,901,372 | 2/1990 | Pierce . | |
| 4,942,626 | 7/1990 | Stern et al. . | |
| 5,062,161 | 11/1991 | Sutton . | |
| 5,070,543 | 12/1991 | Beck . | |
| 5,087,499 | 2/1992 | Sullivan . | |
| 5,363,508 | 11/1994 | Kim | 2/21 |

FOREIGN PATENT DOCUMENTS

| | | | |
|---|---|---|---|
| 172852 | 4/1952 | Germany | 2/21 |

*Primary Examiner*—Paul C. Lewis

*Attorney, Agent, or Firm*—Townsend and Townsend Crew & Guy Chambers

[57] ABSTRACT

A hand puncture protector (10) including a pivoting shell which covers susceptible areas on the back and sides of the wearer's thumb (53), index finger (52) and thenar web space to reduce the risk of injury or infection from accidental punctures from needles and other sharp instruments ("SHARPS"). The pivoting shell is formed of a SHARP impervious material, such as thermoplastic, and has separate thumb (11) and index finger (12) components which are preferably fastened together by a single rivet (30) placed above the thenar web space region. VELCRO straps (20, 21) are affixed to the thumb and index finger regions of the molded shell at about the interphalange joint of the thumb and middle phalanx of the index finger to secure the hand protector to the user's hand. A method of protecting health care professionals from injury or infection by accidental punctures is also disclosed.

9 Claims, 2 Drawing Sheets

HAND PUNCTURE PROTECTOR

TECHNICAL FIELD OF THE INVENTION

The present invention relates to devices for protecting nurses and other health care workers from injury or infection caused by accidental hand punctures from hypodermic needles and other sharp instruments used in patient care ("SHARPS"). More particularly, a pivoting shell is disclosed which covers susceptible areas on the back and sides of the wearer's thumb, index finger and thenar web space to reduce the risk of injury or infection from accidental SHARP sticks.

BACKGROUND OF THE INVENTION

With the recent spread of AIDS, hepatitis-B and other highly infectious diseases, heath care workers are now increasingly at risk to contract such diseases during the performance of their duties. To care for infected patients, health care workers are routinely called upon to use a variety of SHARPS to take blood samples and administer parenteral liquids. It is becoming apparent that health care workers can become infected with such diseases by accidently sticking themselves with a SHARP that has been exposed to the body fluids of an infected patient. For example, cases of accidental sticking have occurred where the health care worker attempts to resheath a contaminated SHARP after use. If the SHARP misses the sheath or enters the sheath at an angle, the SHARP might stick the index finger, thumb or thenar web space of the hand holding the sheath.

A particularly risky situation for the health care worker arises when they are called upon to use a Huber needle and subcutaneous port. The subcutaneous port is a bladder like device which is surgically inserted under the patient's skin and connected to a nearby venous vessel. The subcutaneous port allows fluids, such as chemotherapy fluids, to be conveniently and repeatedly inserted into the venous vessel by giving the health care worker a subcutaneous target for the SHARP (i.e., the subcutaneous port bladder).

Typically, a Huber needle is used to impart fluids to the subcutaneous port. A Huber needle is a type of hypodermic needle with a twist or kink in its end. This twist or kink causes the Huber needle to lock into the mesh which typically forms the top surface of the subcutaneous port bladder. By locking into the mesh, the Huber needle will stay in place and continue imparting necessary fluids despite minor tugs or twists.

To insert a Huber needle into a subcutaneous port, the health care worker must first sense the location of the septum or target of the subcutaneous port with the fingertips of their non-needle holding or "sensing" hand. For a right-handed health care worker, the sensing hand would typically be the left hand and the needle holding hand would be the right hand. The subcutaneous port is then stabilized and immobilized with the tips of the sensing hand thumb and index finger while the point of the Huber needle is inserted through the patient's skin and into the bladder of the subcutaneous port.

One of the high risk parts of working with a Huber needle and subcutaneous port occurs when the Huber needle must be pulled out of the subcutaneous port. Again, the process starts with the tips of the sensing hand thumb and index finger stabilizing and immobilizing the subcutaneous port. With the subcutaneous port stabilized and immobilized, the needle holding hand can then be used to pull the Huber needle out of the subcutaneous port. Since the Huber needle is most often locked into the bladder mesh of the subcutaneous port, the Huber needle may suddenly twist or turn as the Huber needle kink is pulled free of the subcutaneous port mesh. With such sudden twists or turns, the chances of a health care worker accidently sticking their sensing hand thumb, index finger or thenar web space with a contaminated Huber needle are greatly increased. This is particularly true where the patient is moving while the health care worker is trying to remove the Huber needle.

Recognizing the risk of contracting disease through exposure to an infected patient's body fluids, health care workers have searched for ways to minimize such risk. For example, many health care workers routinely wear thin rubber gloves during their work. Nonetheless, while such thin rubber gloves are useful to prevent the spread of infectious disease through existing cuts or abrasions in the health care worker's skin, such thin rubber gloves are too soft and thin to prevent disease transmission from accidental SHARP sticks.

In Stern's U.S. Pat. No. 4,942,626, a dual layered leather glove is disclosed to help protect health care workers from accidental SHARP sticks. This is an elaborately constructed glove which covers all of the hand, except the tips of the index finger and middle finger. While constituting an improvement over thin rubber gloves, such a full leather glove has the disadvantage of still being permeable to forceful SHARP sticks and being too cumbersome for those parts of the hand which are unlikely to be subjected to SHARP sticks.

SUMMARY OF THE INVENTION

The present invention provides a hand puncture protector consisting of a pivoting shell which covers susceptible areas on the back and sides of the wearer's thumb, index finger and thenar web space to reduce the risk of infection from accidental SHARP sticks. In the preferred embodiment, the pivoting shell is formed of a SHARPS impervious material, such as thermoplastic, and has separate thumb and index finger components which are fastened together by a single rivet placed above the dorsal thenar web space. VELCRO straps are preferably affixed to the thumb and index finger regions of the shell at about the interphalange joint of the thumb and middle phalanx of the index finger to secure the hand protector of the present invention to the user's hand. With this construction, the hand protector of the present invention reduces the risk of SHARP sticks by covering the most susceptible areas of the user's sensing hand while leaving the remainder of the user's sensing hand unhindered for tasks which require tactile sensitivity.

The present invention also provides a method of protecting nurses and other health care workers from injury and infection caused by accidently sticking themselves with SHARPS. This method consists of first placing the hand puncture protector of the present invention on the thumb and index finger of the user's sensing hand. The SHARP is then inserted and withdrawn from the patient within the region bounded by the thumb, index finger and thenar web space.

DESCRIPTION OF THE SPECIFIC EMBODIMENTS

Figure 1:
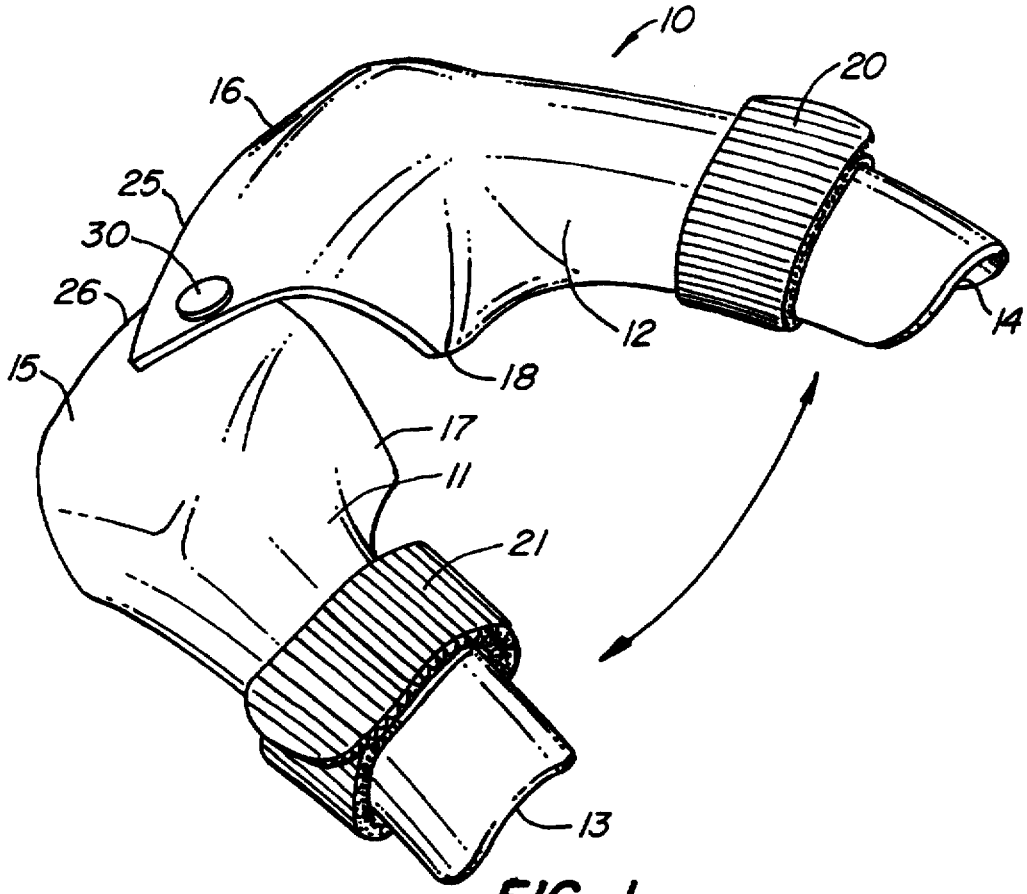
FIG. 1 is a perspective view of the hand puncture protector of the present invention.
Figure 3:
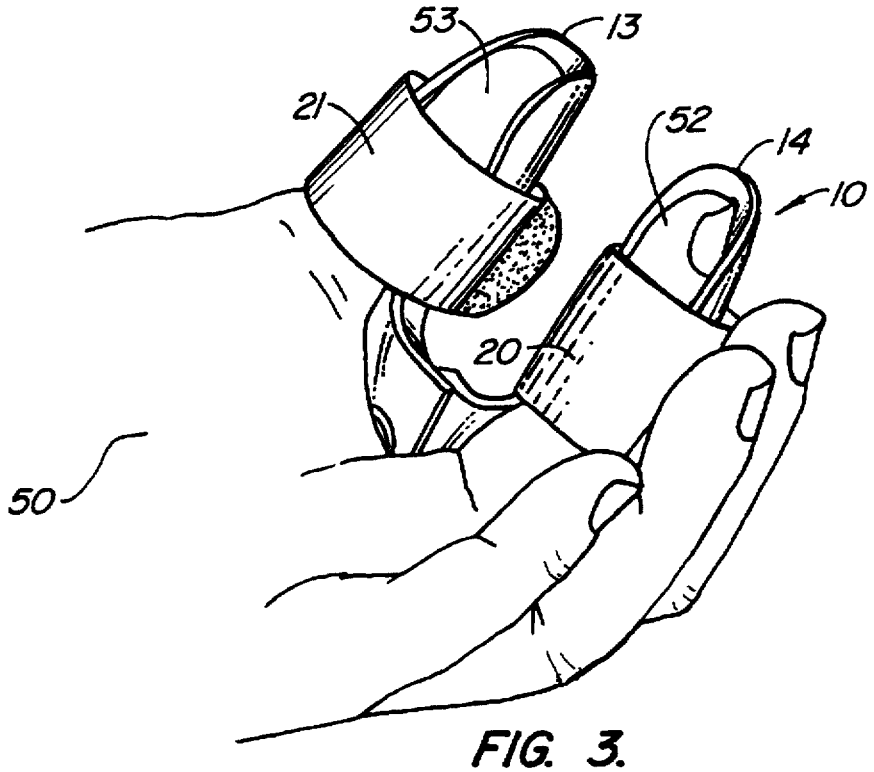
FIG. 3 shows the underside of the hand puncture protector of the present invention as fitted on the sensing hand of a user.

Referring now to FIG. 1, a preferred form of the hand puncture protector 10 of the present invention is shown. This hand puncture protector 10 features a pivoting shell having a thumb component 11 and an index finger component 12. Both the thumb 11 and index finger 12 components of the pivoting shell have distal 13, 14 and proximal 15, 16 ends. As shown in FIG. 3, each distal end 13, 14 of a pivoting shell component should extend past the end of the respective thumb 53 or index finger 52 by at least 1 cm so that the thumb and index finger ends are protected from angular SHARP sticks. The proximal ends 15, 16 of the shell components 11, 12 should together cover nearly all of the dorsal thenar web space region and come close to the wrist.

Both the thumb 11 and index finger 12 components of the pivoting shell are formed of a hard, SHARPS impervious material such as, for example, thermoplastic, metal or KEVLAR®. In the case of thermoplastic, the thumb 11 and index finger 12 components can each be injection molded to the shape of the top and both sides of the thumb or index finger as well as about two thirds of the dorsal thenar web space region. In forming the shell components, the palmar side of the thumb and index finger are left exposed as shown in FIG. 3 so that the user can continue to have patient tactile contact with the pads of the thumb and index finger.

The thumb 11 and index finger 12 components of the pivoting shell are jointed together at their upper dorsal thenar web space edges 25, 26 by a rivet 30. Other suitable fasteners include screw/bolt combinations, gimbals or any other nonabrasive fastener which allows pivotal, rotational or translational movement of the thumb 11 and index finger 12 shell components relative to one another. The location of the fastener 30 should allow enough overlap of the dorsal thenar web space edges 25, 26 so that the pivotable shell will completely cover the dorsal thenar web space during operation. Significantly, this also requires overlap of the lower thenar web space edges 17, 18 when the hand protector of the present invention is opened to its maximum operational extent (e.g., when widened to grip the far edges of a subcutaneous port).

In order to secure the pivoting shell components 11, 12 to the user's hand, straps 20, 21 are preferably affixed to the finger regions of each shell component 11, 12 at about the interphalange joint of the thumb and middle phalanx of the index finger. An effective form of strap for the present invention is a VELCRO™ strap. Such a VELCRO™ strap can be incorporated by, for example, affixing a strip of hook tape transversely across the width of the applicable shell component 11, 12 at about the interphalange joint of the thumb and middle phalanx of the index finger. Such hook tape can be affixed to the shell components 11, 12 with glue or other suitable adhesive. A longer strip of loop tape can then be wrapped around the thumb or index finger and attached at both the loop tape's ends to the affixed hook tape. The use of such a strap on the finger portion of the shell components 11, 12 allows the shell components to be made larger than the user's hand and still be securely fit onto the hand. In this way, one size of hand protector can accommodate a variety of user hand sizes. If such straps 20, 21 were not used, the hand protector would have to be more closely contoured to the shape of the specific user's hand in order to stay on.

Figure 2A:
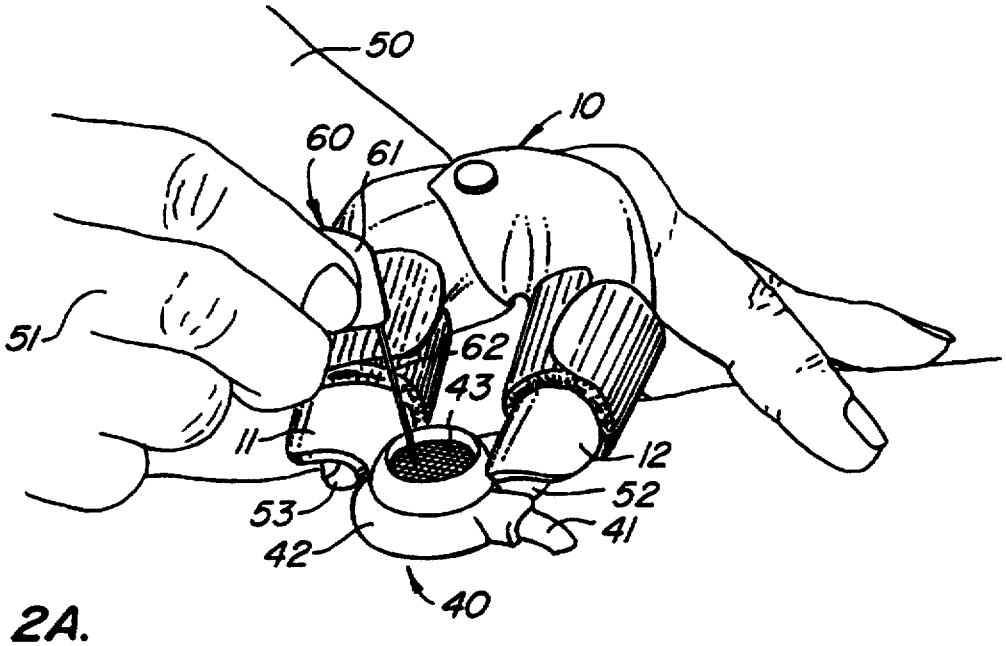
FIG. 2A shows the hand puncture protector of the present invention in use with a Huber needle and simulated subcutaneous port.

FIG. 2A shows the hand protector 10 of the present invention in use with a simulated subcutaneous port 40 and Huber needle 60. A "simulated" subcutaneous port 40 is shown in this Figure because an operational subcutaneous port would be surgically inserted under the skin of the patient where its details could not be seen. This simulated subcutaneous port 40 consists of catheter stub 41, bladder 42 and bladder mesh 43. The Huber needle consists of connector 61 and needle 62. In operation, the Huber needle connector 61 would be attached to a tube from which parenteral fluids were being supplied.

Figure 2B:
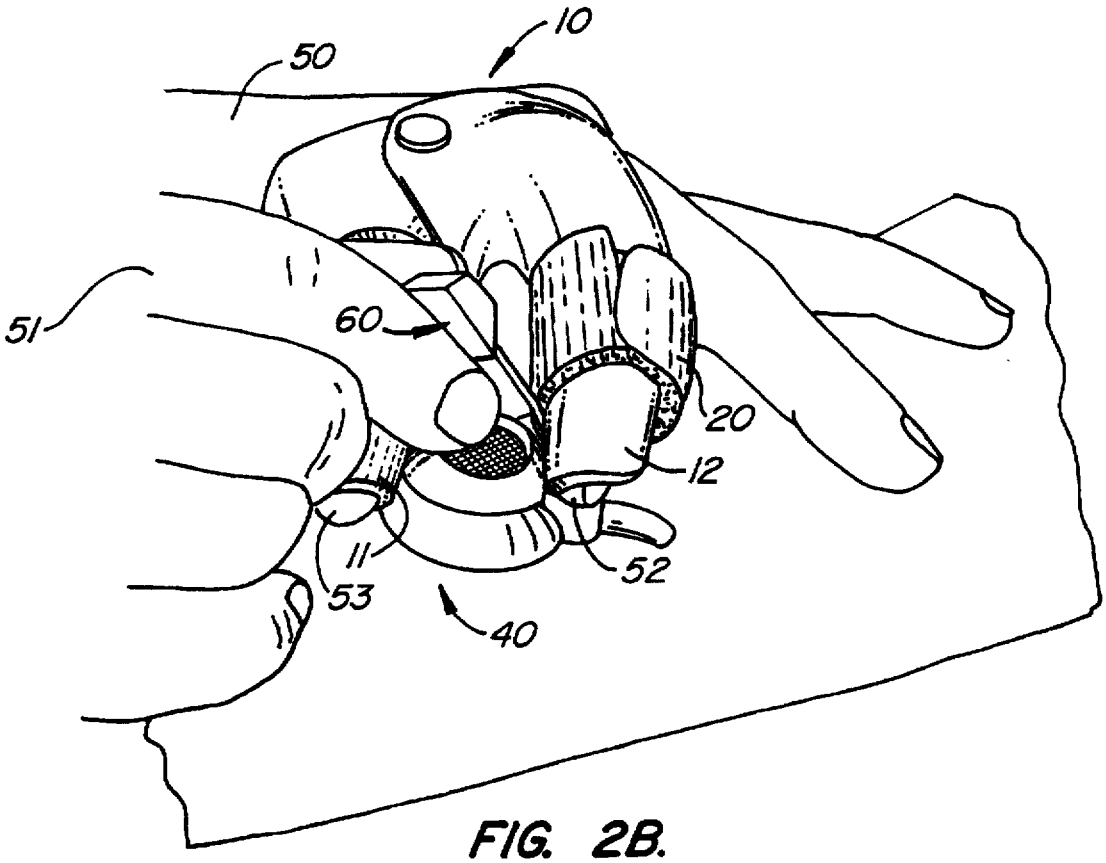
FIG. 2B illustrates how the hand puncture protector of the present invention reduces the risk of accidental needle sticks when used with a simulated subcutaneous port.

FIG. 2A, 2B and 3 show how the hand protector 10 of the present invention is fitted on the sensing hand 50 of the health care worker. The thumb component 11 of the pivoting shell fits over the sensing hand thumb 53 and dorsal thenar web space while the index finger component 12 of the pivoting shell fits over the sensing hand index finger 52 and dorsal thenar web space. In this case, the sensing hand 50 is the left hand. This would be a typical sensing hand for a right-handed health care worker who would want to use their right hand 51 as the needle holding hand. Since users of the present invention would have a variety of hand sizes and hand preferences, embodiments of the invention should be made for both left and right hands as well as in small, medium and large sizes.

FIGS. 2A, 2B and 3 illustrate how the pads of the thumb 53 and index finger 52 are left exposed in the hand protector of the present invention to stabilize and immobilize the subcutaneous port 40. When the thumb 53 and index finger 52 are spread widely enough to grasp the edges of the subcutaneous port 40, there is still enough overlap of the lower thenar web space edges 17, 18 to protect the user's sensing hand thenar web space from accidental needle sticks.

FIG. 2A shows how the Huber needle should be correctly positioned in the mesh 43 of the subcutaneous port 40 during insertion or removal of the Huber needle 60. FIG. 2B shows how the hand protector 10 of the present invention can protect the user's sensing hand index finger 52 from an accidental needle stick if the Huber needle 60 twists or turns as it is being removed from the subcutaneous port 40.

To work with a SHARP using the hand protector 10 of the present invention, one first selects a hand protector 10 that is slightly larger than the thumb and index finger size of the user's sensing hand. One then unfastens the straps 20, 21 on each of the shell components 11, 12 and inserts the thumb and index finger of the sensing hand into the hand protector. In some cases, it may be desirable to sterilize the hand protector before use. Also, rubber gloves may be placed on one or both of the sensing and SHARP holding hands for further germ protection. To reduce the need to repeatedly sterilize the hand protector of the present invention, rubber gloves may advantageously be put on after the hand protector is placed on the sensing hand. In that way, the rubber gloves will protect both the sensing hand and hand protector from germs. After the hand protector is positioned around the thumb and index finger of the sensing hand, the straps 20, 21 are fastened about the interphalange joint of the thumb and middle phalanx of the index finger.

Now that the hand protector is secured to the sensing hand, the exposed pads of the sensing hand thumb and index finger can then be used to find a suitable spot for insertion of the SHARP. Suitable spots may include a vein, muscle or subcutaneous port. The SHARP is then inserted in the region between the thumb, index finger and thenar web space so that all areas of the sensing hand adjacent to the SHARP are protected by SHARP impervious material. Similarly, when appropriate, the SHARP should be withdrawn from the area between the thumb, index finger and thenar web space of the sensing hand. Preferably, the hand protector 10 of the present invention is left on until the contaminated SHARP is resheathed and discarded. The sheath for the SHARP should be gripped by the thumb 11 and index finger 12 components of the pivoting shell so that any accidental SHARP sticks will contact the hand protector 10 rather than the exposed areas of the user's sensing hand.

In the foregoing description, the invention has been described with reference to specific preferred embodiments and methods. It will, however, be evident to those of skill in the art that various modifications and changes may be made without departing from the broader spirit and scope of the invention as set forth in the appended claims. For example, the hand protector 10 of the present invention can also be constructed in the shape of a mitten where the index finger component 11 of the pivoting shell covers all four sensing hand fingers rather than merely the index finger. The specification and drawings are, accordingly, to be regarded in an illustrative, rather than restrictive, sense; the invention being limited only by the appended claims.

What is claimed is:

1. A hand protector for reducing the risk of injury or infection from accidental sticks to a user's hand of a SHARP comprising:

a pivotable shell, made of SHARP impervious material, having thumb and index finger components;

said thumb component constructed to cover the back and sides of the user's thumb as well as a portion of the thenar web space;

said thumb component constructed to cover the back and sides of the user's thumb as well as back and side portions of the thenar web space;

said index finger component constructed to cover the back and sides of the user's index finger as well as back and side portions of the thenar web space and to overlap with said thumb component;

an adjustable strap on each of said thumb and index finger components to hold said components onto the thumb and index finger of said user's hand; and, a fastener to movably connect said thumb and index finger components of said pivotable shell at the thenar web space.

2. The hand protector of claim 1 wherein said straps are hook and loop straps.

3. The hand protector of claim 1 wherein said SHARP impervious material is a thermoplastic.

4. The hand protector of claim 1 wherein said fastener is a rivet.

5. The hand protector of claim 1 wherein said thumb and index finger components are fastened together to pivotally move in the same horizontal plane with respect to one another.

6. A method of reducing the risk of injury or infection to a health care worker from accidently sticking their sensing hand with a SHARP held by their SHARP holding hand comprising:

selecting a hand protector featuring a pivotable, SHARP impervious shell which covers the back and sides of the worker's sensing hand thumb and index finger as well as the back and side of the worker's sensing hand thenar web space and is attached with adjustable straps to the thumb and index finger of the worker's sensing hand;

placing said hand protector over said worker's sensing hand thumb, index finger and thenar web space;

securing said hand protector to said worker's sensing hand; and, manipulating said SHARP within the region bounded by the thumb, index finger and thenar web space of said worker's sensing hand.

7. The method of claim 6 wherein said selecting step includes selecting a hand protector secured to said worker's sensing hand by at least one strap.

8. The method of claim 6 wherein said selecting step includes selecting a hand protector whose impervious shell is made of thermoplastic.

9. The method of claim 6 wherein said manipulating step includes using a Huber needle.

* * * * *